US007964064B2

(12) United States Patent
Weinstein et al.

(10) Patent No.: US 7,964,064 B2
(45) Date of Patent: Jun. 21, 2011

(54) SYSTEM AND METHOD TO CONTROL PRESS SECTION DEWATERING ON PAPER AND PULP DRYING MACHINES USING CHEMICAL DEWATERING AGENTS

(75) Inventors: David Ira Weinstein, Hawthorn Woods, IL (US); Michael Robert St. John, Chicago, IL (US); Rodney H. Banks, Aurora, IL (US); James L. Thomas, Heber Springs, AR (US)

(73) Assignee: Nalco Company, Naperville, IL (US)

( * ) Notice: Subject to any disclaimer, the term of this patent is extended or adjusted under 35 U.S.C. 154(b) by 234 days.

(21) Appl. No.: 12/059,425

(22) Filed: Mar. 31, 2008

(65) Prior Publication Data

US 2008/0179028 A1 Jul. 31, 2008

Related U.S. Application Data

(62) Division of application No. 11/043,700, filed on Jan. 26, 2005, now abandoned.

(51) Int. Cl.
*D21F 13/00* (2006.01)

(52) U.S. Cl. ..... 162/198; 700/128; 34/446

(58) Field of Classification Search ..... 162/198, 162/263, 253; 700/128; 34/446, 447
See application file for complete search history.

(56) References Cited

U.S. PATENT DOCUMENTS 5,377,428 A * 1/1995 Clark ..... 34/446

* cited by examiner

*Primary Examiner* — Mark Halpern
(74) *Attorney, Agent, or Firm* — Joshua D. Bishop; Michael B. Martin

(57) ABSTRACT

The present invention provides an automatic control system, method and paper manufacturing machine using such control system for automatically controlling the amount of press section dewatering via the metered application of chemical dewatering agents applied to a paper web in a paper manufacturing process. The control system includes a feedback controller for controlling the amount of chemical dewatering agent applied to a paper web, and a monitoring device for obtaining a measurement of the moisture of the paper web exiting the press section.

11 Claims, 2 Drawing Sheets

SYSTEM AND METHOD TO CONTROL PRESS SECTION DEWATERING ON PAPER AND PULP DRYING MACHINES USING CHEMICAL DEWATERING AGENTS

CROSS REFERENCE TO RELATED APPLICATION

This application is a divisional application of U.S. patent application Ser. No. 11/043,700, filed on Jan. 26, 2005, now abandoned which is herein incorporated by reference.

BACKGROUND OF THE INVENTION

The present invention relates to paper manufacturing systems and pulp drying manufacturing systems for controlling press section dewatering via the metered application of chemical dewatering agents and thereby having a positive effect on various sheet characteristics imparted by the press section consolidation process.

During a papermaking process in a typical paper machine, a furnish of fiber and water is fed onto a traveling forming fabric. Most of the water then drains through the fabric, to form on the fabric a fibrous web or mat of fibers that includes paper fibers from the furnish. On most paper machines, the paper web exits the couch containing 75 to 80% moisture.

The wet web travels from the couch into a press section where the moisture content can be mechanically reduced to 45-60%. The press section of a paper machine utilizes hydraulic pressure through a series of press nips to subject the web to compressive forces to remove as much water from the web as possible before the sheet continues on to the dryer section. The press section also consolidates the sheet to improve sheet strength, reduce bulk, increase sheet smoothness, and ensure uniform cross direction (CD) moisture distribution.

The web then travels to a drying section in which it traverses drying drums that reduce the water content of the web through evaporation to a final desirable level, yielding a paper product that can be cut or otherwise processed and packaged. Typically, the dryer section produces a paper sheet containing 5-10% moisture.

The extent to which the press section removes water from the web before the dryer is of prime importance to achieving efficient and economical paper machine operation because the drying sections consume large amounts of energy. The dryer section uses steam heat to evaporate free and bound water from the sheet and is the most expensive part of a paper machine in terms of capital and operating costs. Although only 1% of the water in the furnish is removed in the dryer section, the cost per unit of water removed is greater than 20 times that by the press section.

Steam consumption in the dryer section increases dramatically with increased moisture content of an incoming sheet. For example, for a 7% increase in sheet moisture entering the dryer section, steam usage increases by 34% to obtain the same moisture level in the dried sheet. Moreover, the latent heat of steam decreases as its pressure increases making it more costly to operate dryers at high steam pressures even though the steam temperature is higher. Consequently, it is desirable to maximize the removal of water from the web before it enters this section.

As the wet web traverses the press section it is in contact with one or more press fabrics or belts, where the latter can be also defined as a type of press fabric for the purposes of this discussion. Pressing of the web is done between two rolls in the press nip. As the web enters the nip, compression of the web and press fabric begins with entrained air flowing out of both the web and fabric. As the hydraulic pressure increases, water moves from the web into the fabric. When the fabric becomes saturated, surplus water flows out of the fabric. At this point the web is at the point of closest separation between the rolls and the hydraulic pressure is at a maximum. As the web moves out from this point, the pressure returns to zero and the paper sheet is at its maximum dryness. Finally, the paper and fabric exit the press nip and separate from each other causing a slight vacuum in the paper which could result in some rewetting of the paper sheet.

This reabsorption of water is undesirable and efforts have been made to minimize this effect by press section suppliers and paper machine clothing manufacturers. On the machine side, rapid separation of sheet and fabric is made to reduce the rewetting time. In addition, various types of water receptacles are provided to help remove water from the fabric. Paper machine clothing manufacturers also use impermeable belts or low permeability fabrics in specific press positions to reduce the rewetting effect.

The operational factors that determine the amount of water released from the web in a press section can be divided into three categories including machine design, stock and sheet properties, and operational elements. Machine design factors are fixed by the equipment manufacturer and are not controlled by the press operator. These factors include roll hardness and diameter, press configuration, and press nip design.

Variations in the properties of the web entering the press section influence the moisture content of the sheet exiting the press section. These properties include the type of furnish, freeness, amount of fiber fines, amount of filler, inherent water retention, compressibility, basis weight, web temperature, and moisture level. During the papermaking process, these characteristics fluctuate to varying degrees in uncharacterized ways and cause variations in the ultimate moisture content of the sheet leaving the press section. Attempts are made to minimize these variations but are of limited success during paper production.

In the press section, operational factors, such as machine speed, press load, and press fabric design and maintenance can be manipulated to optimize press section efficiency. In practice, these factors are difficult to control since the degrees to which each factor affects sheet moisture at any point in time is generally unknown. Press fabric cleaning and service life have a substantial influence in overall press section operation and are given attention by operators at significant cost to the mill.

The factors described above act as process variances that affect the final product. Currently, few, if any, of these factors are measured during the papermaking operation.

In paper manufacturing it is desirable to maintain an even moisture distribution throughout the sheet as it forms in order to produce high quality paper with uniform basis weight distribution. Poor moisture distribution leads to localized over or under drying, inferior paper quality, increased machine operating costs, and reduced efficiency. Thus, during a run, web moisture before the press section, especially in the cross direction, would be potentially the most important parameter to measure and control. However, in the past this has not been done for reasons of cost and difficulty of implementation.

If moisture were measured, a feed forward control method for controlling various processing parameters could be developed to more accurately control the production of each grade and basis weight of paper. To accomplish this a moisture sensor could be used to determine the moisture of the web just before it enters the press section. A controller could use the moisture value to anticipate the expected moisture of the product exiting the press section and determine a control action to adjust a control element, if necessary. For example, press load, press vacuum or shower water temperature in the press section could be adjusted so as to drive the predicted moisture of the sheet exiting the press to a more desirable value.

The feed forward approach would be difficult to develop as it would require a comprehensive and quantitative knowledge of how press section operational parameters affect dewatering of paper webs having varying incoming moistures and would require quantitative knowledge of how variations in any other unmeasured disturbances, such as web properties and type of paper being made, are affected by such adjustments. Moreover, because feed forward control would only be applicable to the actual press equipment being controlled this information would be unique for each press assembly.

Another potential approach for process control would be to use a feedback loop, which would monitor a measured output variable such as sheet moisture exiting the press section. A feedback controller could then manipulate a process variable such as steam supply, if needed, so that the product has more desirable characteristics. The feedback control algorithm, though unaware of specific disturbances acting on the process, would be able to maintain the output at the desired value so long as the function that manipulates the value is valid and does not cause the process to run in a region outside that for which the control algorithm is defined.

This feedback method and several of its variations (proportional, proportional+integral, or proportional+integral+derivative) have been practiced in other industrial applications such as liquid level control and temperature control.

Feedback control has been implemented by some mills in which final sheet moisture is measured using moisture monitors such as gamma gauges or infrared monitors. These measurement devices are either stationary, in which the moisture content is taken at one location on the cross direction of the sheet, or moving, for which a moisture profile is obtained along the width of the paper. The moisture value is fed to a controller in real time and compared to a preferred moisture level of the final sheet. Based on the difference, a corrective control action is applied to an appropriate control element in an earlier stage of the papermaking process, such as the degree of refining or dilution of the headbox stream, to obtain more desirable final sheet properties.

However, before implementing a process for controlling press section dewatering, detailed studies are required to define the relationships between control actions and their effect on press section dewatering. For example, it would be necessary to determine that increasing the first nip pressure by 46 psi/percentage moisture, water removal increases from 59.2 to 62.8%, when the web has an initial moisture level of 77.1 to 79.2%, a basis weight range from 61 to 82 g/m$^2$, sheet speeds are 805 to 1023 ft/min (240 to 310 m/min), for a light board furnish in the temperature range of 103 to 112° F. (39 to 45° C.). As can be appreciated, a suitable control algorithm would be complicated and time consuming to develop.

For feed forward and feedback strategies, a control action could be specified for a narrow set of operating conditions and output values. However, any uncharacterized disturbance could affect the accuracy of the control algorithm. Algorithm modifications would often be required for routine changes in paper grades or final sheet specifications. Press section operation on new grades of paper would also have to be characterized prior to the development of suitable algorithms. In addition, comparing feed forward control and feedback control, feedback control would be slower since it is dependent on process lag times. However, feedback control would potentially be more forgiving in situations where the process is not completely characterized.

New control systems and methods are needed that require only a basic understanding of the paper manufacturing process without detailed knowledge of the quantitative relationships between inputs and outputs. Ideally such methods could optimize dewatering on any press section, leading to increased paper or paperboard production, and the direct development of improved sheet characteristics despite unknown variations in paper web disturbances or machine types. Additionally, the result of improved sheet moisture control exiting the press can impact other press operational choices such as press fabric design, press load and roll cover characteristics such that these choices enable improved final sheet characteristics to be consistently achieved. Such methods could also be used to lower steam pressures, allowing for the use of cooler roll temperatures in the dryer section. Other advantages to the use of cooler roll temperatures include less radiation loss, lower risk of steam leakage, and in many cases, higher quality paper can be obtained from lower contact surface temperatures.

SUMMARY OF THE INVENTION

The present invention provides an automatic control system and method of use for paper manufacturing machines that provides for automatically controlling the amount of press section dewatering via the metered application of chemical dewatering agents that are applied to a paper web or a paper machine wet end in a paper manufacturing process. The control system includes a feedback controller for controlling the amount of chemical dewatering agent applied and a monitoring device for obtaining either direct or indirect measurements of the moisture content of the paper web at suitable locations.

The control system can be operated in a number of ways. For example, the system can be operated by taking a first measurement of the moisture of the paper web. It can then adjust the amount of chemical dewatering agent applied to the paper web or paper machine wet end and obtain a second moisture measurement. The moisture measurements can be compared to determine the response. If the response is desirable, the adjustment of the amount of chemical dewatering agent is repeated in like fashion. If the response is undesirable the adjustment is reversed.

The control system can also be operated such that the comparison is favorable when the second moisture measurement is closer to a desired preset value than the first measurement. Alternatively, the control system can be operated such that the comparison is favorable when the moisture of the web is reduced.

The invention also provides a paper manufacturing machine or pulp drying machine having a press section that includes such a control system.

In an embodiment of the invention the moisture of the paper is determined indirectly.

In an embodiment of the invention the moisture of the paper is determined by measuring steam consumption in the dryer section.

In an embodiment of the invention the moisture of the paper is determined using weir boxes.

In an embodiment of the invention the moisture determination is the difference between the moisture before the sheet enters the press section and after the sheet exits the press section.

In an embodiment of the invention the moisture of the paper is determined by measuring the water flow from between the press nips.

In an embodiment of the invention the moisture of the paper is determined using in-line flow meter.

In an embodiment of the invention the moisture of the paper is determined using a sonic flow measurement device.

In an embodiment of the invention the moisture of the paper is determined using a gamma gauge.

In an embodiment of the invention the moisture of the paper is determined using an infrared gauge.

In an embodiment of the invention the chemical dewatering agent is added to paper making furnish at typical wet end additive feed locations.

In an embodiment of the invention the chemical dewatering agent is sprayed directly onto the paper web.

In an embodiment of the invention the chemical dewatering agent is sprayed directly onto the paper web at varying levels across the paper (in the CD direction).

The invention also encompasses methods for controlling dewatering of a paper web in the press section. Certain methods involve taking a first measurement of the moisture of the paper web; adjusting the amount of chemical dewatering agent applied to the paper web; then taking a second measurement of the moisture of the paper web and comparing the first and second measurements. The adjustment of the amount of chemical dewatering agent applied to a paper web is then repeated if the comparison is favorable. A different adjustment is made if the comparison is unfavorable.

Additional features and advantages of the present invention are described in, and will be apparent from, the following Detailed Description of the Invention and the figures.

DETAILED DESCRIPTION OF THE INVENTION

Figure 1:
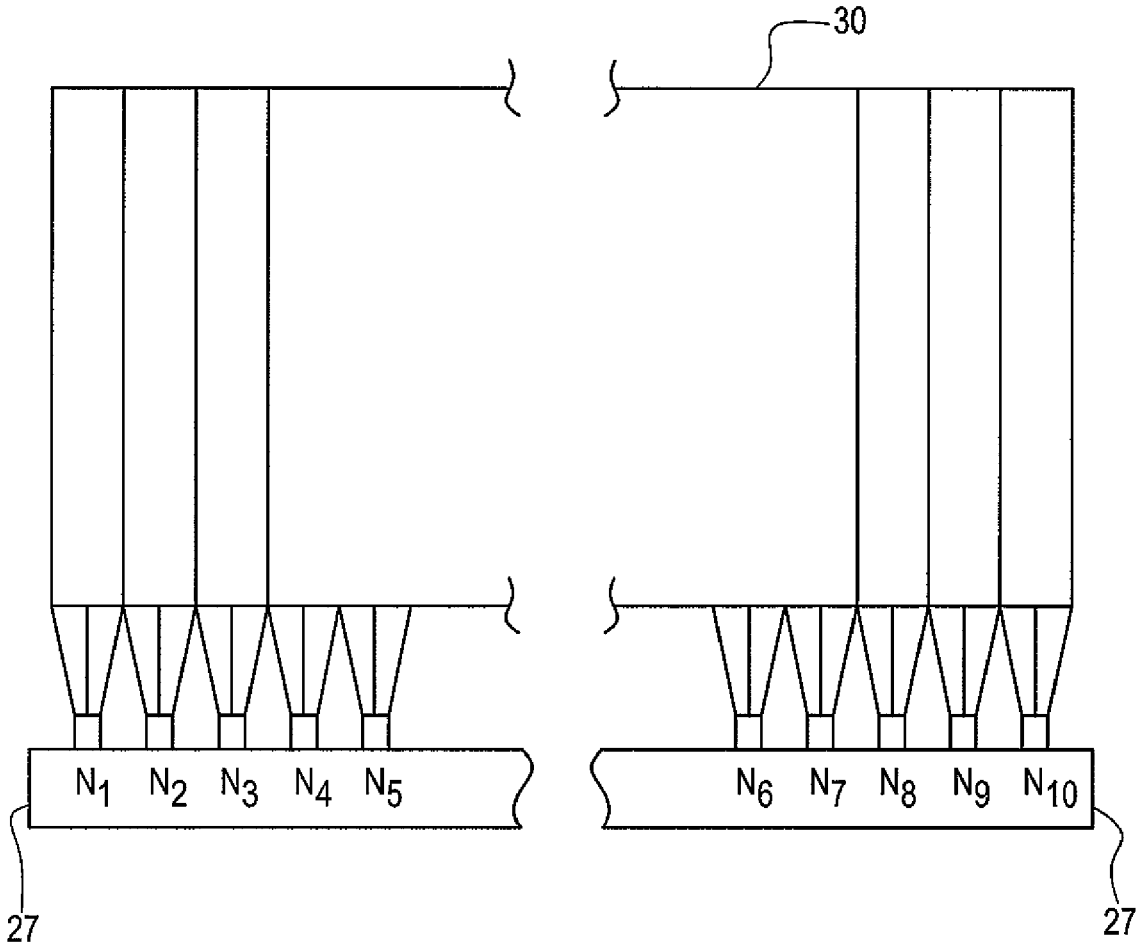
FIG. 1 shows a spray boom holding a number of sprayers in the CD direction across a felt in a paper manufacturing machine. The sprayers can be used to spray a chemical dewatering agent onto a web.

For this invention, "press section dewatering" is defined as the removal of water from the paper web under the mechanical load of the presses and their associated parts and can be specified as the total water removal that occurs in the press section or that of any individual pressing operation.

"Inferential control" is defined as the use of secondary measurements of monitored variables rather than the actual output values, which may not be available due to lack of suitable measurement technology, cost restrictions, or excessive process lag time. Secondary measurements can be used in the invention to infer the effect of process disturbances on process output quality.

In inferential control, secondary measured outputs, together with material and energy balances that are relevant to the paper manufacturing process, are used to mathematically compute the values of the unmeasured controlled variables. These computed values can be utilized by a controller to adjust the values of the manipulated variables. Such computational algorithms may be unduly complex for many industrial processes in cases when numerous process variables come into play.

To simplify development of an inferential control model for press section dewatering, perturbed feedback control can be used. In this method a set point or manipulated variable, such as a set dosage rate of a chemical dewatering agent added to the paper web, can be periodically varied or perturbed intentionally over a given range by a controller and the effect on a measured variable, such as the resulting sheet moisture, can be monitored. A microprocessor can be used to determine if the change to the manipulated variable was good or bad with respect to the process output. In effect, the controller continuously hunts for the optimum value of the manipulated variable by trial and error. Safety precautions, such as setting limits on the range of the manipulated variable, can be set up to prevent an undesirable condition.

As an example of this invention in paper press section dewatering, the controlled output variable can be sheet moisture exiting the press section. This sheet moisture can be measured directly or indirectly. Direct measurements can be made using moisture monitors such as gamma gauges or infrared monitors. These measurement devices can either be stationary, in which the moisture content is taken at one location on the cross direction of the sheet, or moving, for which a moisture profile is obtained along the width of the paper or continuous in the cross direction or multiple measurements can be taken by multiple measurement devices.

In an embodiment and methods, moisture can be inferred by monitoring other parameters, such as water flows from the press section, size press or steam usage rate from the dryer section. Water flows can be measured by any suitable method that can accurately determine the amount of water removed or extracted. Methods for measuring water flows could be by tabular method utilizing a flow depth over a known notched weir or by various types of flowtubes such as magnetic, gravimetric, ultrasonic inference, or by mechanical displacement, for example. Steam usage monitoring devices are also well known and are used commonly in paper mills.

The manipulated variable of this invention can also be the feed rate of chemical dewatering agent applied to the paper web or to the wet end of the paper machine. The chemical dewatering agent can be added to any area in the wet end of the machine. For example, the agent can be added to the standard wet end additives' application points such as the drop leg of the stuff box, inlet to the fan pump and machine chest. When the agent is added to the furnish it can be injected in a continuous or intermittent stream.

More preferably, the chemical agent is added directly to the web just prior to entering the press section. The chemical dewatering agent can be added to the web by any suitable method. For example, agent can be added to the paper web using conventional spray bar technology or with a curtain coating device, like the Hydrosizer™, but clearly any type of device which can introduce the chemical agent to the paper web would be acceptable. In the case of spray application and where moisture is monitored as a function of the width of the web, the spray volume can be varied across the width of the web in order to maintain more uniform moisture across the web. This can be accomplished by attaching multiple spray heads to a boom that extends across the web support and controlling the amount of chemical agent sprayed onto the web from each spray head. Such a system is shown diagrammatically in FIG. 1. FIG. 1 shows a spray boom (27) to which is attached a number of spray nozzles (N1-N10). The spray nozzles can be used to apply chemical dewatering agents across a web (30). In such a configuration the spray can overlap or be substantially separated, as shown. Each nozzle (N1-N10) can be separately controlled so that the agent can be applied to maintain more uniform moisture across the web (30). Any number of nozzles can be used, and any nozzle suitable for the delivery of chemical dewatering agents can be used.

Chemical press section dewatering agents are known in the art and can be used. Any suitable amount of a chemical dewatering agent can be used. For example, the suitable amounts include those amounts at which at least an equal amount of cost savings in the operation are obtained but any chemical which can directly assist the removal of water in the press section could be used. Typically a chemical dewatering agent, applied according to this invention, increases the rate and magnitude of water release in a press section as its dosage is increased up to about 5.0 lb (actives)/ton of paper dewatered. In the control scheme, with such a chemical dewatering agent, the controller can vary the feed rate of chemical in periodic steps within a given range. The range can in some methods be from about 0.5 lb (actives)/ton of paper produced to about 5 lb (actives)/ton, in some methods the range can be from about 1 to about 2 or 3 or about 4 lb (actives)/ton of paper produced. Incremental adjustments to the amount of dewatering agent added can be from about 0.1 lb (actives)/ton to about 0.5 lb (actives)/ton. Incremental dosages could be as low as controllable by the dosing system. This could be as low as 0.1 pound actives per ton of paper produced when dosing to control MD (machine direction) moisture variations. This could also be even lower when dosing to control cross direction moisture variations. For instance, a 50 ml/min change in dewatering agent flow to a 2 inch CD web area could be as low as 0.05 lb (actives)/ton on a 200 inch wide machine manufacturing 42 lb linerboard, but the same flow change on a 300 inch wide machine manufacturing 70 lb offset paper would be 0.015 lb (actives)/ton. The water removal rate from the web is monitored.

Figure 2:
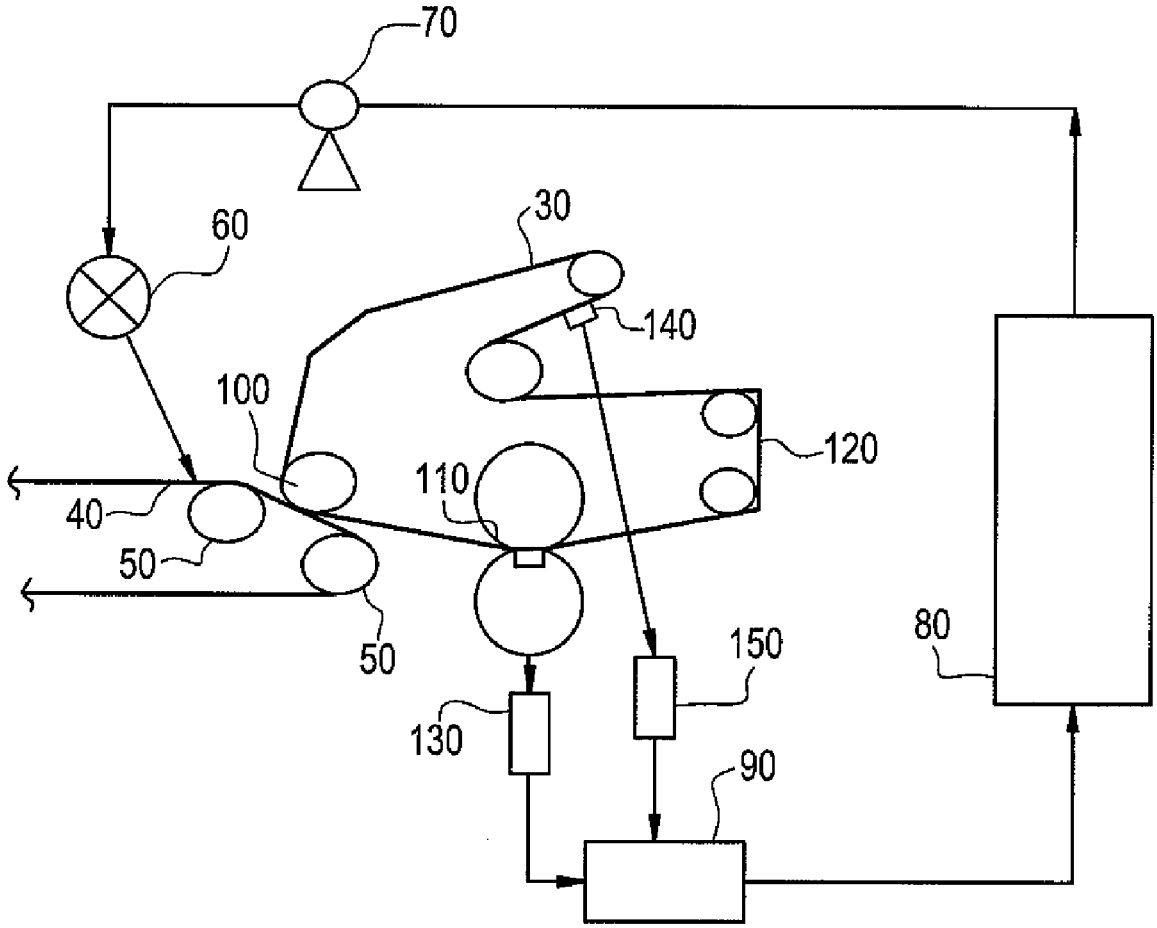
FIG. 2 is a diagrammatic view of one embodiment of a paper machine and control system for controlling the application of a chemical agent to a paper web.

FIG. 2 illustrates one configuration for a paper manufacturing device of the present invention. FIG. 2 shows a paper manufacturing device that includes a forming section and part of a press section (30). A paper furnish is prepared and laid down on the paper machine forming fabric (40). The web is dewatered by gravity and vacuum as water drains through the web and the fabric on which it rests. The forming fabric travels along roll and brings the paper web to the press section. As the web approaches the end of the forming section at the couch roll (50), a chemical dewatering agent is applied from a suitable device such as a spray nozzle (60). Pressure is applied to the device by a chemical pump (70) which is controlled by a feedback controller (80) which may optionally be fed data manually or more preferably by a control system such as a Distributed Control System (DCS) (90), as is known in the art.

After the web passes over the couch roll (50) it is lifted from the forming fabric by a suction roll (100) and enters the press section (30). In the press section (30) the paper web is directed through one or more sets of press nips (110) where it is subjected to pressure that removes additional water. The paper web exits the press nips (110) and travels into a dryer section which is not shown. The press fabric (120) which traverses the press section and supports the web is then directed through a series of rolls, vacuum elements, and cleaning processes, not shown, which continuously maintains the press fabric in a suitable condition for supporting and drying the web.

FIG. 2 shows that water flow from the web can be measured by a water flow measuring device (130) as it exits the press nip (110). Water flow can also be measured by a water flow measuring device (150) as water exits the press fabric at the vacuum box (140). In various embodiments, the water flow devices can measure water in conjunction with each other or can be used separately by themselves. In each case the measurement is communicated to the feedback control device (80) which calculates the effects of the chemical dewatering agent and controls its feed rate via a chemical pump (70).

The press section output variable can be moisture content of the sheet leaving the press section or can be moisture content of the web at a particular location for example at the size press. This variable can be measured indirectly, for example by keeping track of the overall water balance in the system as is known to those having skill in the art. One object of the control scheme is to provide control over this measured value. Water flow from the press, W, which is an indirect measure of the sheet moisture content exiting the press section, can be a measured output variable where control over the sheet moisture exiting the press section is desired. The manipulated variable is the chemical feed rate, F. Other unknown disturbances can be acting on the process, as previously described.

The present control methods can be used to control water content along the length of a paper web. To this end, a desirable water content, WC, at a certain point in the web can be defined and the control process used to maintain the water content of the web at this level. Any suitable method for measuring web moisture can be used. For example, sonic measurements can be made on the press nip and vacuum box flows, or sheet moisture can be determined by a random sampling method from samples of the passing paper web, or by nuclear mass measurement using a gamma gauge to calculate the inferred moisture from the known dry mass.

To this end at initialization, the controller sets the chemical feed rate at a nominal value, $F_1$. The moisture content is measured and fed into the controller as a new response, $W_1$. After a time delay appropriate for the process, the feed rate is adjusted, for example, to a higher value by 10%, $F_2$. The moisture content is again measured as $W_2$. For a given desirable water content, WC, the differences, $WC-W_1$ and $WC-W_2$ are calculated. If $|WC-W_2|<|WC-W_1|$ then the previous action was favorable, i.e. the water content is now more desirable. The controller then proceeds to further increase the chemical feed rate by an amount proportional to $(W_2-W_1)/(F_2-F_1)$, hoping to shift the water content closer to the desirable water content. However, if $|WC-W_2|>|WC-W_1|$ then the previous action was unfavorable, i.e. the water content is now less desirable, and the dosage is then reduced.

This hunting procedure repeats at a given frequency while the dosage moves up and down in response to normal process variations, always seeking to control the water content at the desirable water content.

In certain methods the control can be exerted to provide uniform moisture content across the web. For example, in the CD direction, moisture can be controlled by exerting control over the amount of dewatering agent applied to the web in the CD direction using an array of sprayers suitably positioned to deliver varying amounts of agent across the web. As described previously, this can be accomplished by measuring the moisture content across the sheet and applying more or less chemical dewatering agent across the sheet as needed to obtain a more uniform moisture content.

Alternatively, the control methods can be used to maximize dewatering in a sheet. To this end, at initialization, the controller sets the chemical feed rate at a nominal value, $F_1$. The water flow is measured and fed into the controller as a new response, $W_{new}$. After a time delay appropriate for the process, the feed rate is adjusted, for example, to a new, higher value by 10%, $F_2$. The water flow rate is again measured and becomes $W_{new}$ and the previous value becomes $W_{old}$. The difference, $W_{new}-W_{old}$, is calculated and tested as being positive or negative. A positive value indicates a favorable response, i.e. the water flow rate increased and the paper sheet is drier as it exits the press section. The controller then proceeds to further increase the chemical feed rate by an mount proportional to $(W_{new}-W_{old})/(F_2-F_1)$, with the goal to improve dewatering again. If the difference, $W_{new}-W_{old}$, is negative, then the response is unfavorable and the dosage is then reduced.

This hunting procedure repeats at a given frequency while the dosage moves up and down in response to normal process variations, always seeking to maximize water release. If the chemical effect always leads to increased dewatering, then the dosage will approach the maximum allowed limit imposed by the control algorithm. If there is a single optimum chemical dosage, then the controller will manipulate the feed pump in an oscillatory fashion in response to normal process and web variations. The advantages of this control method are that it is resistant to unknown or unexpected process variations and it is versatile in its application to any paper grade, machine type, press configuration or press section efficiency.

In one embodiment of the invention a conventional single nip, single or double felted press section can be employed. Control of press section dewatering in this configuration allows for the use of a decreased press load which can provide improved sheet bulk and lower basis weight for caliper driven paper grades. This may be particularly useful in situations where typical press loads are at or near maximum limits in certain equipment configurations. By controlling the dewatering or outgoing press section moisture, the operating window for the press section press load can be increased so that press loads are not always required to approach their limit. Currently, in the absence of dewatering control, decreased press loads on heavyweight grades would lead to reduced manufacturing speed when incoming press section solids are not suitable. As a result, most press section operating parameters are currently configured in a "set and forget" mode with no operator control because of the inability to specifically measure and control press section solids. Use of the present methods allows for a broader operating window with respect to press load and allows for the same maximum line speeds and a lower basis weight or higher caliper product. The present methods also allow for increased calendaring opportunities for improving smoothness.

In an embodiment a multi-ply gap former or fourdrinier with top dewatering unit can be employed. This configuration allows for the use of the invention in each ply, if so desired. By utilizing the invention, the operator can vary the amount of chemical dewatering agent by ply in order to maintain consistent press section solids across a given basis weight range. This method will provide the advantage of reducing the press section variability caused by ply weight variation and the potential for "sealing" due to premature drainage in a typical gapformer arrangement. It will also provide the advantage of minimizing variation in ply bond, tensile, and smoothness developed across the press section. Currently, these variables are controlled through ply weight changes, vacuum changes, headbox consistency changes, and refining changes. All of these control variables can be used to make gross adjustments to overall sheet characteristics but dewatering control is specifically targeted to control of press section solids.

Given any press configuration or grade scenario, the invention utilized in a cross directional (CD) control configuration provides improved CD control of press section dewatering. This provides similar benefits to a crown control press but provides much greater control over smaller zones. When operated in the CD direction the present system also provides for application of various chemistries across the CD area of the web in order to develop various sheet characteristics. This will allow greater CD profile control of both basis weight and moisture and tighter control limits under normal conditions. The use of such methods could provide for the use of lower basis weights or improved bulk while at the same time still meeting end user specifications.

EXAMPLE 1

This example demonstrates the press section dewatering effect obtained after the addition of varying amounts of a chemical dewatering agent.

Controlled trials were conducted on a paper board machine by applying the chemical agent in a spray application to the paper web prior to entry into the press section. Product doses were varied from 0-1.5 lb (actives)/ton over a four hour period. Measurements of sheet consistency were made periodically before sheet entry into the press section and sheet exit out of the press section during the time period that coincided with chemical dose variation. Sheet consistency measurement can be made by random sampling method of the passing paper web, or by nuclear mass measurement (gamma gauge) to calculate the inferred moisture from the known dry mass. Chemical additives were two different variations of the glyoxylated DADMAC (diallyldimethylammonium chloride)/AcAm (ammonium acetate) type, and the mill was manufacturing a corrugating medium grade using 100% recycle fiber (normally consisting of 80/20 parts OCC (Old Corrugated Containers)/MW (Mixed Waste)).

The results show an increase in sheet dewatering in the press section, as determined by a sheet solids increase, for two products tested. Water removal was increased from about 20.9% when no chemical was added to about 21.7 and 22.4% when 0.5 lbs (actives)/ton, to about 22.1 and 22.5% when 1 lb (actives)/ton, to about 22.4 and 23.1 when 1.5 lbs actives of chemical dewatering agent was added per ton of paper.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method for controlling dewatering of a paper web during a paper manufacturing process, the method comprising:

(a) taking a first measurement of the moisture of the paper web;

(b) adjusting a dosage rate of a chemical dewatering agent applied to the paper web;

(c) taking a second measurement of the moisture of the paper web;

(d) comparing the first and second measurements; and (e) readjusting the dosage rate of the chemical dewatering agent applied to the paper web, the readjusting based on the comparing the first and second measurements; wherein the chemical dewatering agent comprises a chemical, the rate of water release from the paper web increases as the dosage rate of the chemical increases.

2. The method of claim 1 wherein the moisture of the paper web is determined according to a method selected from the group consisting of measuring steam consumption in a dryer section, using weir boxes, measuring water flow from between the press nips, using an in-line flow meter, and using a sonic flow measurement device.

3. The method of claim 1 wherein the moisture determination is the difference between the moisture before the sheet enters a press section and after the sheet exits the press section.

4. The method of claim 1 wherein the moisture of the paper is determined using a gamma gauge.

5. The method of claim 1 wherein the moisture of the paper is determined using an infrared gauge.

6. The method of claim 1 wherein the chemical dewatering agent is added to the papermaking furnish in a wet end of a paper manufacturing process.

7. The method of claim 1 wherein the chemical dewatering agent is sprayed directly onto the paper web.

8. The method of claim 1 wherein the chemical dewatering agent is sprayed directly onto a paper web at varying levels in a CD direction.

9. The method of claim 1 wherein the chemical dewatering agent applied to the paper web is regulated via the use of the feedback controller that receives a signal from a monitoring device that measures the moisture of the paper web.

10. The method of claim 9 wherein the feedback controller is a manual controller operation.

11. The method of claim 1 wherein the chemical dewatering agent applied to the paper web comprises glyoxylated DADMAC/ammonium acetate.

* * * * *